US008993507B2

(12) United States Patent
Hood et al.

(10) Patent No.: US 8,993,507 B2
(45) Date of Patent: Mar. 31, 2015

(54) FUNCTIONAL ADDITIVES FOR CLEANSING COMPOSITIONS

(75) Inventors: David K. Hood, Basking Ridge, NJ (US); Karyn B. Visscher, Morris Plains, NJ (US); Tony Gough, Basingstoke (GB); Surya Kamin, Skillman, NJ (US); Purvita Shah, Jersey City, NJ (US); Jayanti V. Patel, Elmwood Park, NJ (US); Sarah Orton, Epsom (GB); Osama M. Musa, Kinnelon, NJ (US)

(73) Assignee: ISP Investments Inc., Wilmington, DE (US)

( * ) Notice: Subject to any disclaimer, the term of this patent is extended or adjusted under 35 U.S.C. 154(b) by 0 days.

(21) Appl. No.: 13/634,426

(22) PCT Filed: Mar. 11, 2011

(86) PCT No.: PCT/US2011/028111

§ 371 (c)(1),
(2), (4) Date: Nov. 16, 2012

(87) PCT Pub. No.: WO2011/112944

PCT Pub. Date: Sep. 15, 2011

(65) Prior Publication Data

US 2013/0198968 A1 Aug. 8, 2013

Related U.S. Application Data

(60) Provisional application No. 61/313,323, filed on Mar. 12, 2010.

(51) Int. Cl.

| | |
|---|---|
| ***B08B 3/04*** | (2006.01) |
| ***C11D 3/37*** | (2006.01) |
| ***C11D 3/00*** | (2006.01) |

(52) U.S. Cl.

CPC ..... *C11D 3/3792* (2013.01); *C11D 3/0021* (2013.01); *C11D 3/0036* (2013.01); *C11D 3/3769* (2013.01); *C11D 3/3776* (2013.01)

USPC ..... 510/475; 510/360; 510/361; 8/137

(58) Field of Classification Search

USPC ..... 510/360, 361, 475; 8/137

See application file for complete search history.

(56) References Cited

U.S. PATENT DOCUMENTS

| | | | | |
|---|---|---|---|---|
| 4,579,681 | A * | 4/1986 | Ruppert et al. | 510/299 |
| 6,949,498 | B2 | 9/2005 | Murphy et al. | |
| 2003/0118730 | A1 * | 6/2003 | Aouad et al. | 427/294 |

OTHER PUBLICATIONS

PCT, International Search Report, International Application No. PCT/US2011/028111 (mailed May 11, 2011; published Sep. 15, 2011).

* cited by examiner

*Primary Examiner* — Brian P Mruk

(74) *Attorney, Agent, or Firm* — William J. Davis

(57) ABSTRACT

Functional additives for cleansing compositions exhibiting enhanced anti soil-re-deposition and/or dye transfer inhibitory properties comprising polymers in the form of homopolymers, copolymers or terpolymers synthesized from at least one hydrophobic monomer. Examples of hydrophobic monomers include N-vinyl caprolactam, vinyl acetate, vinyl esters, acrylated glycols, methacrylamide, C1 to C12 alkyl- and C1 to C12 dialkylacrylamide, C1 to C12 alkyl- and C1 to C12 dialkylmethacrylamide, C1 to C12 alkyl aery late, C1 to C12 alkyl methacrylate, 4-butyl phenyl maleimide, octyl acrylamide.

9 Claims, 1 Drawing Sheet

FUNCTIONAL ADDITIVES FOR CLEANSING COMPOSITIONS

CROSS-REFERENCE TO RELATED APPLICATIONS

This present application claims priority to U.S. Provisional Application No. 61/313,323 filed Mar. 12, 2010, the entire content of which is hereby incorporated by reference.

FIELD

The present application relates to polymeric additives and their incorporation into cleaning compositions useful in household detergents and other related uses. Particularly, the invention relates to the enhancement of soil dispersion compositions that not only clean fabrics and articles of clothing but reduce the re-deposition of soils and stains/dyes thereon. More particularly, the present invention relates to functional additives for cleansing compositions having enhanced anti soil-re-deposition (ASR) and/or dye transfer inhibitory (DTI) activities comprising polymers in the form of homopolymers, copolymers or terpolymers synthesized from at least one hydrophobic monomer. Examples of hydrophobic monomers include N-vinyl caprolactam, vinyl acetate, vinyl esters, acrylated glycols, methacrylamide, C1 to C12 alkyl- and C1 to C12 dialkylacrylamide, C1 to C12 alkyl- and C1 to C12 dialkylmethacrylamide, C1 to C12 alkyl acrylate, C1 to C12 alkyl methacrylate, 4-butyl phenyl maleimide, octyl acrylamide.

The functional additives described herein are suitable for use in cleaners and detergent applications, attributing to their anti-soil redeposition and dye transfer inhibiting functions. Also disclosed in accordance with one embodiment, the copolymer or terpolymer units may be derived from hydrolyzable monomers exhibiting biodegradable activity.

BACKGROUND

In general, cleaning and laundry detergent compositions exhibit benefits such as soil detergency, anti soil-redeposition, and dye transfer inhibition.

The prime purpose of a cleaner and detergent is to render the textile or surface free from stains and soils. In most laundering processes such as conventional home washing machines or hand washing with detergent bars, the elimination of stains and soils in a washing cycle is a complex task. For example, synthetic fibers tend to be hydrophobic and readily accumulate contaminates such as dirt, oils and greases; which can be difficult to remove. Moreover, even assuming that the undesirable materials are removed from the textile and/or a fairly clean textile material is being washed; oftentimes soil remaining in the wash water is redeposited onto the textile material prior to the end of the wash cycle. Hence, when the textile material is removed from the washing machine and subsequently dried, it has not been properly cleaned. Thus, textile materials after use rarely assume a truly clean appearance, but instead tend to gray and/or yellow due to the soil and/or oily materials being deposited or redeposited and remaining thereon.

Typical soil release agents that have been developed for synthetic fibers and fabrics include the copolymers of ethylene glycol and terephthalic acid for the treatment of various synthetic fibers and fabrics, such as Dacron®, Fortrel®, Kodel® and Blue C® Polyester. Such high molecular weight (e.g., 40,000 to 50,000 M.W.) polyesters containing random ethylene terephthalate/polyethylene glycol terephthalate units have been used as soil release compounds in laundry detergent compositions as disclosed in U.S. Pat. Nos. 3,962,152 and 3,959,230.

There are many known polymeric ASR agents. Typical examples include carboxymethyl cellulose (CMC), modified cellulose ethers, polyesters, polyethylene glycol polyester copolymers, hydroxyl terminated polyurethanes, polyacrylic acids and their salts, polymers of vinylidene ester/unsaturated acids or anhydrides, fluorocarbons, styrenic acrylates, poly (ethylene glycol-co-vinyl acetate), bentonites, and ethanol amines. They are water soluble and typically negatively charged materials. Carboxymethyl cellulose (CMC) is a commonly used ASR agent and it is used at low levels (0.5-2.0 percent) in commercially available laundry detergents.

French Patent 805,718 (1936), assigned to Kalle and Co. A. G, discloses sodium carboxy methylcellulose (CMC) as an additive in synthetic detergents to help keep soil from re-depositing on clothes in the laundry.

Journal of the American Oil Chemist's Society; 40, no. 11; 1963; pp 669, discloses that adsorption of CMC on cotton demonstrates exceptional efficiency in the presence of non-ionic polymers (i.e., PVP or PVA), the polymer adsorption on soil particles enhances the cleaning effect.

U.S. Pat. No. 4,579,681 (A) (1986), assigned to GAF, discloses polymers and co-polymers of vinyl caprolactam (VCL) are useful as an additive in synthetic detergents to help keep soil from re-depositing on clothes in the laundry. Preferred examples of co-polymers include poly(vinyl caprolactam-co-vinyl pyrrolidone (VP)) and poly(vinyl caprolactam-co-vinyl pyrrolidone-co-dimethylaminoethyl methacrylate (DMAEMA)).

Another U.S. Pat. No. 4,444,561 (A1) (1984), assigned to BASF, discloses polymers and co-polymers of vinyl lactams useful as an additive in synthetic detergents to help keep soil from re-depositing on clothes in the laundry.

Yet another U.S. Pat. No. 5,142,020 (A) (1992), assigned to BASF, discloses polyesters comprised of nonionic surfactants as condensed units are useful as an ASR agents.

U.S. Pat. No. 6,498,136 (B2) (2002), assigned to National Starch, discloses polymers having a hydrophilic backbone and hydrophobic moieties are useful as soil suspension agents in powdered detergents.

Another troublesome and persistent problem during laundering operations is the tendency of some colored fabrics to release dye into the laundering solution which dye is then transferred onto other fabrics. Dye transfer during the wash cycle is caused by higher water temperature, longer cycle time, and much higher surfactant concentration in the wash cycle, as compared to the less stringent conditions of the rinse cycle.

Dye transfer inhibitors (DTI), such as PVP, appear to solubilize into the wash water to scavenge the free dye molecules, thus suspending the dyes and preventing them from redepositing onto fabrics.

U.S. Pat. No. 5,458,810 relates to dye transfer inhibiting compositions comprising polyamine N-oxide containing polymers and enzymes. The polyamine N-oxide polymers provide a stabilizing effect for enzymes formulated in detergent compositions.

U.S. Pat. No. 5,849,684 relates to detergent additives comprising dye transfer inhibitors, and process for making them. The compositions include a powder builder such as zeolite and the dye transfer inhibition polymers polyamine N-oxide, and copolymers of N-vinylpyrrolidone and N-vinylimidazole.

EP0754748 relates to dye transfer inhibiting compositions comprising a polymer selected from water-soluble vinylpyridine copolymers. Examples of suitable copolymerizing groups included formic acid, arylic acid, maleic acid, vinylpyrrolidone, vinyl acetate. Preferred copolymers are based on 4-vinylpyridine with vinylpyrrolidone, acrylic acid and maleic acid.

Thus soil release agents (SRA), anti soil-redeposition agents (ASR) and Dye Transfer inhibitors (DTI) are key functional ingredients in cleaning compositions, i.e., textiles, laundry and hard surfaces such as carpet-cleaning and textile treating.

It would be beneficial to have a composition comprising a combination of polymers for blended benefit of ASR and DTI or a dual functional ASR/DTI polymer.

The present application discloses functional polymeric additives (FPA) with a purpose to boost the cleaner and detergent's ability in providing enhanced anti soil-redeposition and/or dye transfer inhibitory activities. In accordance with certain embodiments, the series of co-polymers described herein can function as ASR and DTI agents thereby minimizing the number of additives combined with detergents. The co-polymers may be derived from hydrophobic monomers such as N-vinyl caprolactam, vinyl acetate, vinyl esters, acrylated glycols, methacrylamide, C1 to C12 alkyl- and C1 to C12 dialkylacrylamide, C1 to C12 alkyl- and C1 to C12 dialkylmethacrylamide, C1 to C12 alkyl acrylate, C1 to C12 alkyl methacrylate, 4-butyl phenyl maleimide, and octyl acrylamide.

In accordance with certain embodiments, hydrolyzable monomeric units are incorporated into the co-polymers/terpolymers to provide biodegradability to the resulting co-polymers/terpolymers thus making the present invention environmentally favorable.

SUMMARY

Cleansing compositions comprising functional additives derived from hydrophobically modified polymeric systems as described herein exhibit enhanced anti soil-redeposition action. Functional additives additionally may have dye transfer inhibitory effect which further broadens the usefulness of the functional additives described herein.

In accordance with one aspect of the present invention, there is provided a functional additive having enhanced anti soil-redeposition and/or dye transfer inhibitory activities particularly suited for use in cleaning compositions.

More specifically, the present application discloses functional additives for cleansing compositions having enhanced anti soil-redeposition and/or dye transfer inhibitory activities comprising polymers in the form of homopolymers, copolymers or terpolymers synthesized from at least one hydrophobic monomer. Examples of hydrophobic monomers include N-vinyl caprolactam, vinyl acetate, vinyl esters, acrylated glycols, methacrylamide, C1 to C12 alkyl- and C1 to C12 dialkylacrylamide, C1 to C12 alkyl- and C1 to C12 dialkylmethacrylamide, C1 to C12 alkyl acrylate, C1 to C12 alkyl methacrylate, 4-butyl phenyl maleimide, and octyl acrylamide.

In accordance with particular embodiments, the polymer may contain monomer(s) selected from the group consisting of vinyl pyrrolidone (VP), vinyl caprolactam (VCL or VCap), vinyl amide, vinyl ester, vinyl imidazole (VI), styrene, α-methyl styrene, N-allyl lactams, N-allyl amides, 2-ethylhexyl acrylate, octyl acrylate, lauryl acrylate, stearyl acrylate, behenyl acrylate, acrylated lactams, 2-ethylhexyl methacrylate (2-EHMA), 4-vinyl (4-Vpy) pyridine, 2-vinyl pyridine (2-VPy), octyl methacrylate, lauryl methacrylate (LMA), stearyl methacrylate, 2-phenoxy ethyl acrylate (PEA), behenyl methacrylate, 2-ethylhexyl acrylamide, octyl acrylamide (OAA), lauryl acrylamide, stearyl acrylamide, behenyl acrylamide, propyl acrylate, butyl acrylate, vinyl acetate (VA), butyl vinyl ether, pentyl acrylate, hexyl acrylate, 1-vinyl naphthalene, 2-vinyl naphthalene, 3-methyl styrene, 4-propyl styrene, t-butyl styrene, 4-cyclohexyl styrene, 4-dodecyl styrene, 2-ethyl-4-benzyl styrene, 4-butyl-phenyl maleimide (4-MI), 4-(phenylbutyl) styrene, ethyl acrylate, 2-ethylhexyl-diglycol acrylate, 2-(2-ethoxyethoxy)ethyl acrylate (EOEOEA), lauryl acrylate (LA), Stearyl acrylate (SA), isobornyl acrylate (IBOA), acrylic acid-2-ethylhexyl ester, isodecyl acrylate, acryloyl morpholine (ACMO), cyclic trimethylol-propane formal acrylate (CTFA), 3-(Methacryloylamino)propyl]trimethylammonium chloride (MAPTAC), (3-Acrylamidopropyl)trimethylammonium chloride (APTAC), C8-C10 acrylate (ODA), isodecyl acrylate (ISODA), lauryl methacrylate (LM), stearyl methacrylate (SM), 2,2,2-Trifluoroethyl methacrylate, 2-Acrylamido-2-methyl-1-propanesulfonic acid, 2-Acrylamido-2-methyl-1-propanesulfonic acid sodium salt, [2-(Methacryloyloxy)ethyl] dimethyl-(3-sulfopropyl)ammonium hydroxide, [3-(Methacryloylamino)propyl]dimethyl(3-sulfopropyl) ammonium hydroxide inner salt, and methyl methacrylate.

In a particularly useful embodiment, the polymers may be selected from the group consisting of vinyl caprolactam-vinyl acetate copolymers, vinyl lactam-vinyl acetate-vinyl alcohol terpolymers, vinyl amide-vinyl acetate-vinyl alcohol terpolymers, vinyl caprolactam-vinyl imidazole-vinyl acetate terpolymers, vinyl caprolactam-vinyl acetate-PEA terpolymers, vinyl lactam-polyethylene glycol methacrylate-vinyl acetate copolymers, polyethylene glycol acrylate-vinyl lactam-vinyl acetate copolymers, Poly(vinyl caprolactam) copolymers, vinyl caprolactam-vinyl pyridine-vinyl acetate terpolymers, vinyl caprolactam-lauryl methacrylate copolymers, vinyl caprolactam-lauryl methacrylate-vinyl acetate terpolymers, vinyl pyridine-acrylate copolymers, vinyl pyridine-2-ethylhexyl acrylate copolymers, vinyl caprolactam-2-ethylhexyl acrylate copolymers, vinyl pyridine-lauryl methacrylate copolymers, vinyl caprolactam-2-ethylhexyl acrylate-vinyl acetate terpolymers, vinyl pyridine-vinyl acetate-lauryl methacrylate terpolymers, vinyl caprolactam-vinyl pyridine-N-oxide-vinyl acetate terpolymers, vinyl pyridine-octyl methacrylate copolymers, vinyl caprolactam-vinyl acetate-octyl methacrylate terpolymers, vinyl pyridine-hydroxy ethyl pyrrolidone (HEP) methacrylate copolymers, vinyl caprolactam-TBAEMA/hydroxylethyl methacrylate (HEMA) copolymers, vinyl pyridine-4-butyl-phenyl maleimide copolymers, their salts, vinyl pyrrolidone-4-butyl-phenyl maleimide copolymers esters, derivatives and mixtures thereof.

In another embodiment, at least one monomer selected is hydrolyzable and the hydrolyzable monomer may be selected from the group consisting of vinyl acetate, vinyl alcohol, methylene dioxepane, and acrylated lactams. The functional additive having greater than 10% of the copolymer or terpolymer units derived from hydrolyzable monomers exhibits biodegradable activity.

The hydrophobically modified polymer can be used in an amount from about 0.001 to 50 weight percent, based on the total weight of the cleansing composition, more particularly in an amount of from about 0.01 to 25 weight percent and still more particularly in an amount from about 0.1 to 5 weight percent.

In accordance with certain aspects, the cleansing composition may be in the form of a liquid, solid, semisolid, emulsion, dispersion, or a gel. In yet other embodiments, a cleaning composition containing a functional additive may be incorporated onto a non-woven textile.

The cleansing composition described herein may contain other usual laundry detergent components such as surfactants, builders, chelants, bleaching agents, oxidizing agents, supplementary soil-suspending agents, foam suppressors, additional soil release agents, optical brighteners, abrasives, bactericides, tarnish inhibitors, coloring agents, perfumes, and mixtures thereof.

The present application also provides methods of cleaning fabric with enhanced anti soil-redeposition and/or minimizing dye transfer during the wash cycle of a laundering process comprising (a) washing a load of fabrics in a wash solution containing a cleansing composition comprising functional additives having enhanced anti soil-redeposition and/or dye transfer inhibitory activities comprising polymers in the form of homopolymers, copolymers or terpolymers synthesized from at least one hydrophobically modified monomer selected from the group consisting of N-vinyl lactam, N-vinyl cyclic lactam, N-vinyl ether, N-vinyl ester, N-vinyl alcohol, Vinyl N-oxide, acrylamide, acrylated glycols, methacrylamide, C1 to C12 alkyl- and C1 to C12 dialkylacrylamide, C1 to C12 alkyl- and C1 to C12 dialkylmethacrylamide, C1 to C12 alkyl acrylate, and C1 to C12 alkyl methacrylate; (b) rinsing the load of fabrics; (c) drying the load of fabrics; and (d) washing all or part of said load of fabrics, together with or without additional fabrics, the load releasing an effective amount of anti soil-redeposition effect and/or dye transfer inhibitor into a wash solution containing a cleansing composition.

The fabric is not particularly limited. Examples of fabric include cotton, denim, polyacrylics, polyamides, polyesters, polyolefins, rayons, wool, linen, jute, ramie, hemp, sisal, regenerated cellulosic fibers such as rayon or cellulose acetate, leather, and combinations thereof.

The functional additive of the present invention can be used as a premix or can be reconstituted into a liquid composition prior to addition to the wash solution or forms the integral part of cleansing composition.

DETAILED DESCRIPTION

Figure 1:
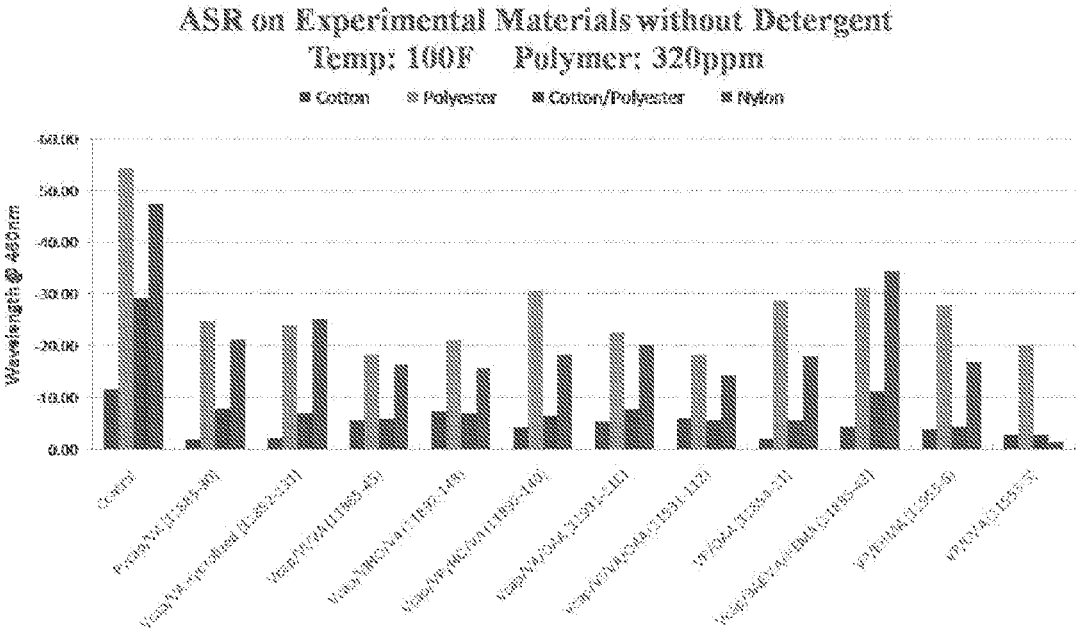
FIG. 1 is a graph illustrating the ASR on experimental materials without detergent.

The present application relates to compositions and processes useful for preventing soil from redepositing and/or inhibiting the transfer of dyes, released in to laundering solution from soiled and/or colored fabrics, from one fabric to another.

More particularly, this disclosure relates to a functional additive composition comprising polymers derived from hydrophobic monomers. These polymeric functional additives typically exhibit excellent dispersibility, adsorptivity and high calcium-ion capturing capability (particularly those derived from N-vinyl cyclic lactam polymer); and also have textile substantivity and prolonged ASR activity through several wash cycles, which may be particularly attributed to their vinyl caprolactam moiety.

Further, some of the polymers derived from the hydrolyzable monomeric moieties such as esters linkages in the polymer chain enables the copolymer/terpolymer to exhibit biodegradability.

The present invention involves the preparation of polymeric functional additives suitable for use in cleaning and detergent applications. In some cases, these polymeric additives are uniquely formed to provide the dual function of anti-soil redeposition and/or dye transfer inhibition to the cleaning composition.

The term "functional polymer additive" (FPA) used in connection with the present application refers to polymers derived from hydrophobic monomers. The FPA is functionally capable of exhibiting at least one of the functions selected from soil release, anti-soil redeposition and dye transfer inhibition. These polymers can be in the form of homopolymers, copolymers and terpolymers.

The term "Anti-Soil Redeposition" (ASR) used in connection with the present invention refers to agents (FPA's), used in laundry detergent application, capable of not only releasing the initial stains and soil but also for the prevention of redeposition of soils and dyes during the wash cycle. This functional use is commonly referred to as "Anti-Soil Redeposition" (ASR).

The term "Soil Release" (SR) used in connection with the present invention refers to agents (FPA's) used in laundry detergent application, wherein a sacrificial functional polymeric layer is deposited on the textile surface during the textile pre-treatment process of textile cleaning. Upon a traditional laundering procedure, the sacrificial FPA layer releases, along with any contaminates, into the wash liquor. This functional use is commonly referred to as "Soil Release" (SR).

The term "Dye Transfer Inhibition" (DTI) used in connection with the present invention refers to the agents, used in laundry detergent application, capable of capturing fugitive dye(s) during the textile cleaning process thereby preventing the dye(s) from re-depositing onto the surface of a textile. This functional use of such agents is commonly referred to as "Dye Transfer Inhibition" (DTI).

The terms "hydrophobic monomers" and "hydrophobically modified monomers" used in connection with the present application refer to hydrophobic monomers, introduction of which bring hydrophobicity to the polymers and copolymers derived from such monomers. Homopolymers formed from hydrophobic monomers would be water insoluble.

Examples of hydrophobic monomers include N-vinyl caprolactam, vinyl acetate, vinyl esters, acrylated glycols, methacrylamide, C1 to C12 alkyl- and C1 to C12 dialkylacrylamide, C1 to C12 alkyl- and C1 to C12 dialkylmethacrylamide, C1 to C12 alkyl acrylate, C1 to C12 alkyl methacrylate, 4-butyl phenyl maleimide, octyl acrylamide.

Other monomers that may be utilized in producing the polymers described herein include N-vinyl lactam, N-vinyl cyclic lactam, N-vinyl ether, N-vinyl ester, N-vinyl alcohol, and Vinyl N-oxide.

In a particular embodiment, the polymers useful herein may be derived from one or more monomers such as vinyl pyrrolidone, vinyl caprolactam, vinyl amide, vinyl ester, vinyl imidazole, styrene, α-methyl styrene, 2-ethylhexyl acrylate, octyl acrylate, lauryl acrylate, stearyl acrylate, behenyl acrylate, acrylated lactams, 2-ethylhexyl methacrylate, 4-vinyl pyridine, 2-vinyl pyridine, octyl methacrylate, lauryl methacrylate, vinyl acetate, vinyl alcohol, stearyl methacrylate, 2-phenoxy ethyl acrylate, N-allyl lactams, N-allyl amides, behenyl methacrylate, 2-ethylhexyl acrylamide, octyl acrylamide, lauryl acrylamide, stearyl acrylamide, behenyl acrylamide, propyl acrylate, butyl acrylate, butyl vinyl ether, pentyl acrylate, hexyl acrylate, 1-vinyl naphthalene, 2-vinyl naphthalene, 3-methyl styrene, 4-propyl styrene, t-butyl styrene, 4-cyclohexyl styrene, 4-dodecyl styrene, 2-ethyl-4-benzyl styrene, 4-(phenylbutyl)styrene, ethyl acrylate, and methyl methacrylate.

Examples of various polymeric functional additives derived from such hydrophobic monomers are provided below and include vinyl caprolactam-vinyl acetate copolymers, vinyl lactam-vinyl acetate-vinyl alcohol terpolymers, vinyl amide-vinyl acetate-vinyl alcohol terpolymers, vinyl caprolactam-vinyl imidazole-vinyl acetate terpolymers, vinyl caprolactam-vinyl acetate-PEA terpolymers, polyethylene glycol Methacrylate-vinyl acetate copolymers, polyethylene glycol Acrylate-vinyl acetate copolymers, Poly(vinyl caprolactam) copolymers, vinyl caprolactam-vinyl pyridine-vinyl acetate terpolymers, vinyl caprolactam-lauryl methacrylate copolymers, vinyl caprolactam-lauryl methacrylate-vinyl acetate terpolymers, vinyl pyridine-2-ethylhexyl acrylate copolymers, vinyl caprolactam-2-ethylhexyl acrylate copolymers, vinyl pyridine-lauryl methacrylate copolymers, vinyl caprolactam-2-ethylhexyl acrylate-vinyl acetate terpolymers, vinyl pyridine-vinyl acetate-lauryl methacrylate terpolymers, vinyl caprolactam-vinyl pyridine-N-oxide-vinyl acetate terpolymers, vinyl pyridine-octyl methacrylate copolymers, vinyl caprolactam-vinyl acetate-octyl methacrylate terpolymers, vinyl pyridine-HEP methacrylate copolymers, vinyl caprolactam-TBAEMA/HEMA copolymers, vinyl pyridine-4-MI copolymers, their salts, esters, derivatives and mixtures thereof.

EXAMPLES OF FUNCTIONAL ADDITIVE POLYMERS

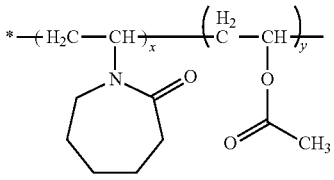

VCap/VA

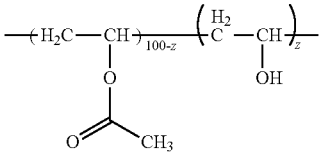

z = 88, 98

VA/VOH

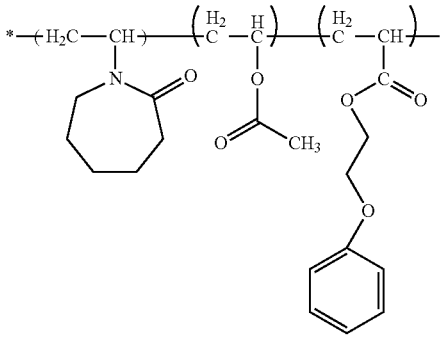

VCap/VA/PEA

-continued

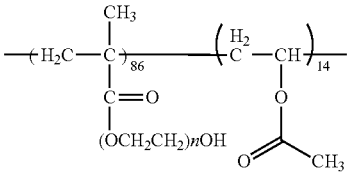

PEG-Methacrylate/VA

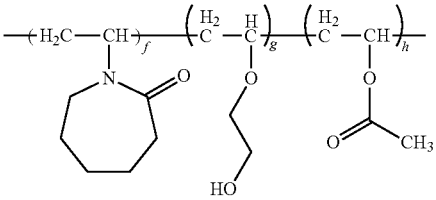

VCap/HEA/VA

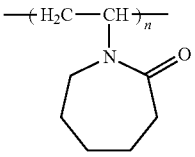

Poly(VCap)

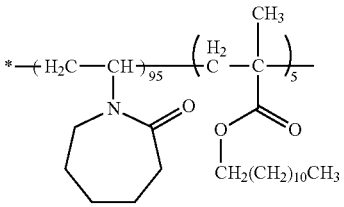

VCap/LMA

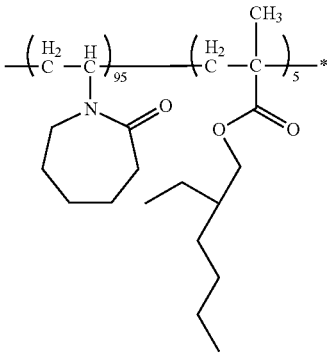

VCap/2-EHMA

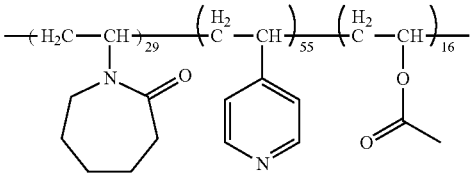

VCap/VPy/VA

-continued
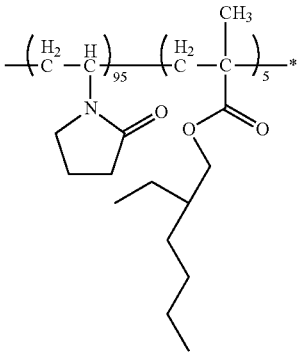
Vp/2-EHMA
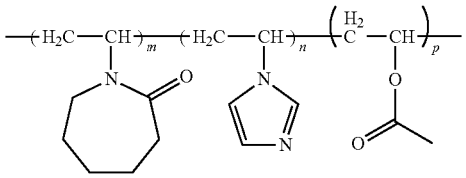
Neutralized with either $CH_3COOH$ or LAS
VCap/VI/VA
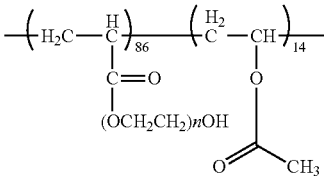
PEG-Acrylate/VA
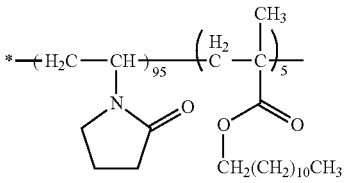
Vp/LMA
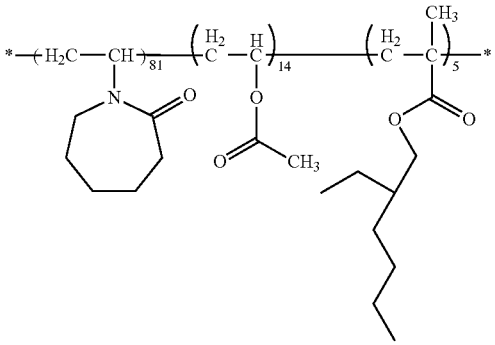
VCap/VA/EHMA
-continued
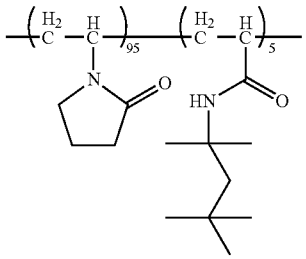
Vp/OAA
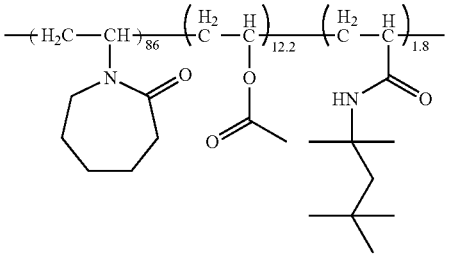
VCap/VA/OAA
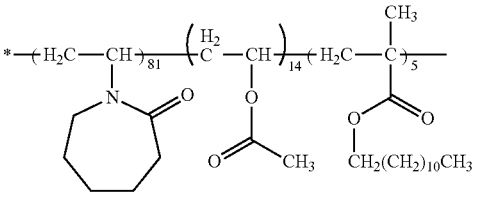
VCap/VA/LMA
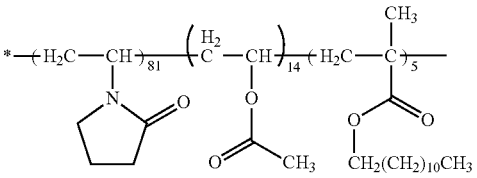
Vp/VA/LMA
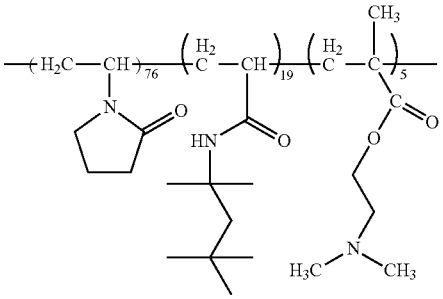
Vp/DMAEMA/OAA (76/19/05)

-continued

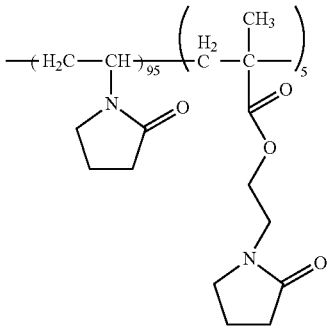

Vp/HEP-Methacrylate (95/5)

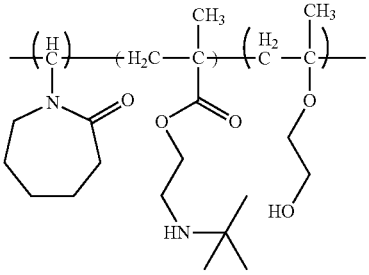

VCap/TBAEMA/HEMA

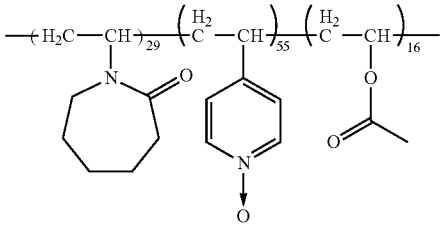

VCap/VPyNO/VA

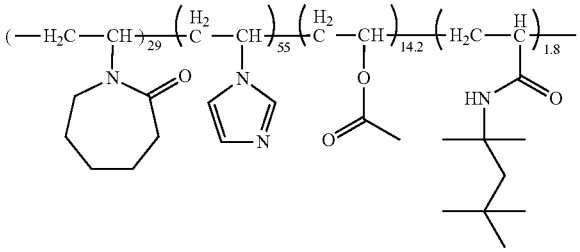

VCap/VI/VA/OAA

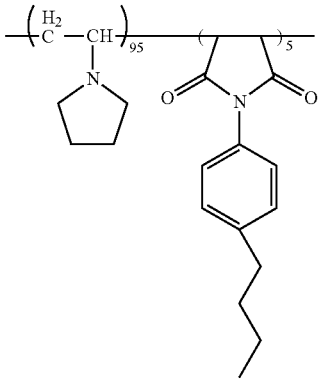

Vp/4-MI (95/5)

The following examples are presented to illustrate specific embodiments of the present compositions and methods. These examples should not be interpreted as limitations upon the scope of the invention.

Example 1

Preparation of Functional Additives Polymers

Polymer 1: VCap/VA (86/14) Co-Polymer

In a flask equipped with a stir bar, condenser, thermocouple and nitrogen purge place 230.29 g ethanol. Purge the solvent with nitrogen over 20 minutes. Heat the solvent to reflux. The following monomer feeds are prepared: monomer Feed 1 is 10.00 g Vinyl acetate; monomer Feed 2 is 87.00 g Vinyl caprolactam. Feed 1 is added to the reaction, drop-wise over 60 minutes (concurrently with Feed 2). Feed 2 is added to the reaction, drop-wise over 120 minutes (concurrently with Feed 1). In a separate vessel, a mixture of 1.0 g of Trigonox 25C 75 and 5.0 g of ethanol is prepared and is labeled as "Initiator Solution". After Feeds 1 and 2 have been adding for 10 minutes, add 1.0 g of the Initiator Solution to the reaction vessel. Continue the drop-wise addition of Feeds 1 and 2 to the reaction vessel. After 30 minutes of monomer feed, charge 1.0 g of the initiator solution to the reaction vessel. After 60 minutes of monomer feed, charge 1.0 g of the initiator solution to the reaction vessel. After 90 minutes of monomer feed, charge 1.0 g of the initiator solution to the reaction vessel. At the completion of the monomer feeds, charge the remaining initiator solution to the reaction vessel. Heat the reaction at reflux for an additional 3 hours. After the 3 hour heating charge the reaction vessel with 0.5 g of Triganox 25C 75 and hold for 120 minutes. Add an additional charge of 0.5 g Triganox 25C 75 and hold for 5 hours. Cool and collect reaction product.

Representative Structure of VCap/VA

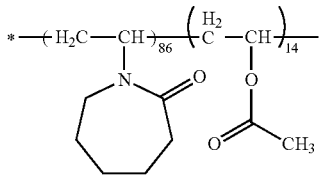

VCap/VA

Polymer 1a: Hydrolyzed VCap/VA (86/14) Co-Polymer 10 grams of Polymer 1 was dissolved in 20 grams of Ethanol. The solution was heated to 80° C. with stirring. 0.43 grams of sodium hydroxide dissolved in 20 grams deionized water was added and the solution was allowed to reflux for two hours. Upon cooling, pH of the solution was adjusted to ~7 with glacial acetic acid.

Representative Structure

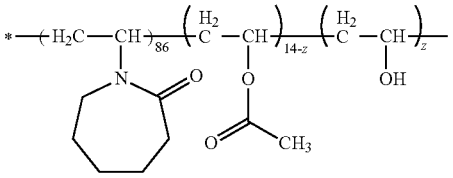

VCap/VA/VOH

Polymer 2: VCap/VI/VA (29/55/16) Terpolymer

In a flask equipped with a stir bar, condenser, thermocouple and nitrogen purge place 239.0 g ethanol. Purge the solvent with nitrogen over 20 minutes. Heat the solvent to reflux. The following monomer feeds are prepared: monomer Feed 1 is 13.80 g vinyl acetate/10.00 g ethanol; monomer Feed 2 is 40.30 g vinyl caprolactam/51.7 g vinyl imidizole. Feed 1 is added to the reaction, drop-wise over 60 minutes (concurrently with Feed 2). Feed 2 is added to the reaction, drop-wise over 120 minutes (concurrently with Feed 1). In a separate vessel, a mixture of 1.0 g of Trigonox 25C 75 and 5.0 g of ethanol is prepared and is labeled as "Initiator Solution". After Feeds 1 and 2 have been adding for 10 minutes, add 1.0 g of the Initiator Solution to the reaction vessel. Continue the drop-wise addition of Feeds 1 and 2 to the reaction vessel. After 30 minutes of monomer feed, charge 1.0 g of the initiator solution to the reaction vessel. After 60 minutes of monomer feed, charge 1.0 g of the initiator solution to the reaction vessel. After 90 minutes of monomer feed, charge 1.0 g of the initiator solution to the reaction vessel. At the completion of the monomer feeds, charge the remaining initiator solution to the reaction vessel. Heat the reaction at reflux for an additional 3 hours. After the 3 hour heating charge the reaction vessel with 0.5 g of Triganox 25C 75 and hold for 120 minutes. Add an additional charge of 0.5 g Triganox 25C 75 and hold for 5 hours. Cool and collect reaction product.

Representative Structure of VCap/VI/VA

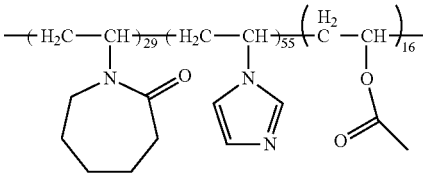

VCap/VI/VA

Polymer 3: VCap/LMA (95/5) Co-Polymer

In a flask equipped with a stir bar, condenser, thermocouple and nitrogen purge place 239.0 g ethanol. Purge the solvent with nitrogen over 20 minutes. Heat the solvent to reflux. The following monomer feeds are prepared: monomer Feed 1 is 9.44 g lauryl methacrylate/10.00 g ethanol; monomer Feed 2 is 97.99 g vinyl caprolactam. Feed 1 is added to the reaction, drop-wise over 180 minutes (concurrently with Feed 2). Feed 2 is added to the reaction, drop-wise over 180 minutes (concurrently with Feed 1). In a separate vessel, a mixture of 1.0 g of Trigonox 25C 75 and 5.0 g of ethanol is prepared and is labeled as "Initiator Solution". After Feeds 1 and 2 have been adding for 10 minutes, add 1.0 g of the Initiator Solution to the reaction vessel. Continue the drop-wise addition of Feeds 1 and 2 to the reaction vessel. After 30 minutes of monomer feed, charge 1.0 g of the initiator solution to the reaction vessel. After 60 minutes of monomer feed, charge 1.0 g of the initiator solution to the reaction vessel. After 120 minutes of monomer feed, charge 1.0 g of the initiator solution to the reaction vessel. At the completion of the monomer feeds, charge the remaining initiator solution to the reaction vessel. Heat the reaction at reflux for an additional 3 hours. After the 3 hour heating charge the reaction vessel with 0.5 g of Triganox 25C 75 and hold for 120 minutes. Add an additional charge of 0.5 g Triganox 25C 75 and hold for 5 hours. Cool and collect reaction product.

Representative Structure of VCap/LMA

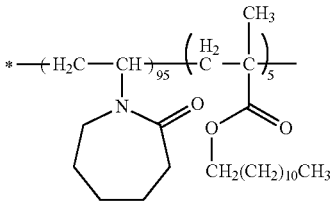

VCap/LMA

Polymer 4: VCap/VA/LMA (81/14/5) Terpolymer

In a flask equipped with a stir bar, condenser, thermocouple and nitrogen purge place 210.0 g ethanol. Purge the solvent with nitrogen over 20 minutes. Heat the solvent to reflux. The following monomer feeds are prepared: monomer Feed 1 is 8.93 g vinyl acetate; monomer Feed 2 is 83.54 g vinyl caprolactam/9.43 g lauryl methacrylate. Feed 1 is added to the reaction, drop-wise over 180 minutes (concurrently with Feed 2). Feed 2 is added to the reaction, drop-wise over 180 minutes (concurrently with Feed 1). In a separate vessel, a mixture of 1.0 g of Trigonox 25C 75 and 5.0 g of ethanol is prepared and is labeled as "Initiator Solution". After Feeds 1 and 2 have been adding for 10 minutes, add 1.0 g of the Initiator Solution to the reaction vessel. Continue the drop-wise addition of Feeds 1 and 2 to the reaction vessel. After 30 minutes of monomer feed, charge 1.0 g of the initiator solution to the reaction vessel. After 60 minutes of monomer feed, charge 1.0 g of the initiator solution to the reaction vessel. After 120 minutes of monomer feed, charge 1.0 g of the initiator solution to the reaction vessel. At the completion of the monomer feeds, charge the remaining initiator solution to the reaction vessel. Heat the reaction at reflux for an additional 3 hours. After the 3 hour heating charge the reaction vessel with 0.5 g of Triganox 25C 75 and hold for 120 minutes. Add an additional charge of 0.5 g Triganox 25C 75 and hold for 5 hours. Cool and collect reaction product.

Representative Structure of VCap/VA/LMA

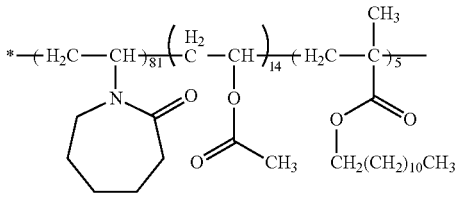

VCap/VA/LMA

Polymer 5: 4-VPy/LMA (95/5) Co-Polymer

In a flask equipped with a stir bar, condenser, thermocouple and nitrogen purge place 239.0 g ethanol. Purge the solvent with nitrogen over 20 minutes. Heat the solvent to reflux. The following monomer feeds are prepared: monomer Feed 1 is 9.44 g lauryl methacrylate/10.00 g ethanol; monomer Feed 2 is 72.04 g 4-vinyl pyridine. Feed 1 is added to the reaction, drop-wise over 180 minutes (concurrently with Feed 2). Feed 2 is added to the reaction, drop-wise over 180 minutes (concurrently with Feed 1). In a separate vessel, a mixture of 1.0 g of Trigonox 25C 75 and 5.0 g of ethanol is prepared and is labeled as "Initiator Solution". After Feeds 1 and 2 have been adding for 10 minutes, add 1.0 g of the Initiator Solution to the reaction vessel. Continue the drop-wise addition of Feeds 1 and 2 to the reaction vessel. After 30 minutes of monomer feed, charge 1.0 g of the initiator solution to the reaction vessel. After 60 minutes of monomer feed, charge 1.0 g of the initiator solution to the reaction vessel. After 120 minutes of monomer feed, charge 1.0 g of the initiator solution to the reaction vessel. At the completion of the monomer feeds, charge the remaining initiator solution to the reaction vessel. Heat the reaction at reflux for an additional 3 hours. After the 3 hour heating charge the reaction vessel with 0.5 g of Triganox 25C 75 and hold for 120 minutes. Add an additional charge of 0.5 g Triganox 25C 75 and hold for 5 hours. Cool and collect reaction product.

Representative Structure of 4-VPy/LMA

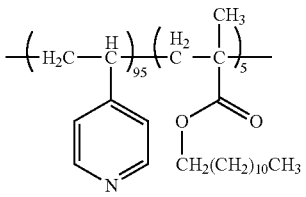

Polymer 5a: 4-VPy(N->Oxide)/LMA (95/5) Co-Polymer

In a flask equipped with a stir bar, condenser and thermocouple place 5.26 g Polymer 5, 50 g acetic acid, peracetic acid (made by mixing 25 g acetic acid and 6.4 g 30% H2O2) and 4-5 drops of sulfuric acid. Stir for 30 minutes at room temperature to dissolve Polymer 5. Next, heat the reaction mixture to 85 C and hold for 3 hours. After the 3 hours, cool to room temperature and allow to stir overnight at room temperature. Pour reaction mixture into 1 L acetone to precipitate the product. Agitate for 30 minutes. After this time, stop the agitation and allow product to settle and decant off the acetone. Add a second 1 L of acetone and agitate the mixture to 'wash' the precipitated product. Filter, wash with additional acetone and dry the product. The product will be a white/cream colored powder.

Representative Structure

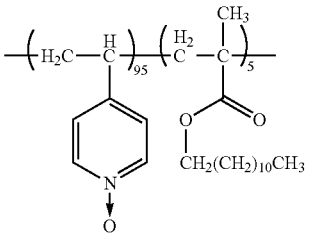

4-Vpy(N->O)/LMA

Polymer 6: 4-VPy/2-EHMA (95/5) Co-Polymer

In a flask equipped with a stir bar, condenser, thermocouple and nitrogen purge place 239.0 g ethanol. Purge the solvent with nitrogen over 20 minutes. Heat the solvent to reflux. The following monomer feeds are prepared: monomer Feed 1 is 7.36 g 2-ethylhexyl methacrylate/10.00 g ethanol; monomer Feed 2 is 72.04 g 4-vinyl pyridine. Feed 1 is added to the reaction, drop-wise over 180 minutes (concurrently with Feed 2). Feed 2 is added to the reaction, drop-wise over 180 minutes (concurrently with Feed 1). In a separate vessel, a mixture of 1.0 g of Trigonox 25C 75 and 5.0 g of ethanol is prepared and is labeled as "Initiator Solution". After Feeds 1 and 2 have been adding for 10 minutes, add 1.0 g of the Initiator Solution to the reaction vessel. Continue the drop-wise addition of Feeds 1 and 2 to the reaction vessel. After 30 minutes of monomer feed, charge 1.0 g of the initiator solution to the reaction vessel. After 60 minutes of monomer feed, charge 1.0 g of the initiator solution to the reaction vessel. After 120 minutes of monomer feed, charge 1.0 g of the initiator solution to the reaction vessel. At the completion of the monomer feeds, charge the remaining initiator solution to the reaction vessel. Heat the reaction at reflux for an additional 3 hours. After the 3 hour heating charge the reaction vessel with 0.5 g of Triganox 25C 75 and hold for 120 minutes. Add an additional charge of 0.5 g Triganox 25C 75 and hold for 5 hours. Cool and collect reaction product.

Representative Structure of 4-VPy/2-EHMA

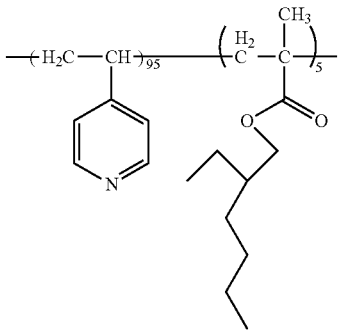

Polymer 6a: 4-VPy(N->Oxide)/EHMA (95/5) Co-Polymer

In a flask equipped with a stir bar, condenser and thermocouple place 5.26 g Polymer 6, 50 g acetic acid, peracetic acid (made by mixing 25 g acetic acid and 6.4 g 30% H2O2) and 4-5 drops of sulfuric acid. Stir for 30 minutes at room temperature to dissolve Polymer 6. Next, heat the reaction mixture to 85 C and hold for 3 hours. After the 3 hours, cool to room temperature and allow to stir overnight at room temperature. Pour reaction mixture into 1 L acetone to precipitate the product. Agitate for 30 minutes. After this time, stop the agitation and allow product to settle and decant off the acetone. Add a second 1 L of acetone and agitate the mixture to 'wash' the precipitated product. Filter, wash with additional acetone and dry the product. The product will be a white/cream colored powder.

Representative Structure

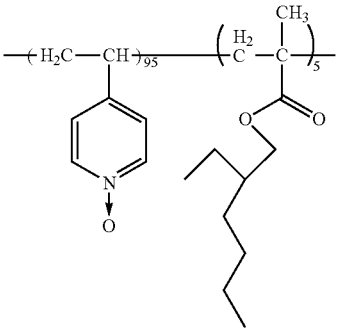

4-Vpy(N->O)/2-EHMA

Polymer 7: 4-VPy/OAA (95/5) Co-Polymer

In a flask equipped with a stir bar, condenser, thermocouple and nitrogen purge place 189.0 g ethanol. Purge the solvent with nitrogen over 20 minutes. Heat the solvent to reflux. The following monomer feeds are prepared: monomer Feed 1 is 6.79 g octylacrylamide/50.00 g ethanol (dissolve OAA in EtOH); monomer Feed 2 is 72.04 g 4-vinyl pyridine. Feed 1 is added to the reaction, drop-wise over 180 minutes (concurrently with Feed 2). Feed 2 is added to the reaction, drop-wise over 180 minutes (concurrently with Feed 1). In a separate vessel, a mixture of 1.0 g of Trigonox 25C 75 and 5.0 g of ethanol is prepared and is labeled as "Initiator Solution". After Feeds 1 and 2 have been adding for 10 minutes, add 1.0 g of the Initiator Solution to the reaction vessel. Continue the drop-wise addition of Feeds 1 and 2 to the reaction vessel. After 30 minutes of monomer feed, charge 1.0 g of the initiator solution to the reaction vessel. After 60 minutes of monomer feed, charge 1.0 g of the initiator solution to the reaction vessel. After 120 minutes of monomer feed, charge 1.0 g of the initiator solution to the reaction vessel. At the completion of the monomer feeds, charge the remaining initiator solution to the reaction vessel. Heat the reaction at reflux for an additional 3 hours. After the 3 hour heating charge the reaction vessel with 0.5 g of Triganox 25C 75 and hold for 120 minutes. Add an additional charge of 0.5 g Triganox 25C 75 and hold for 5 hours. Cool and collect reaction product.

Representative Structure of 4-VPy/OAA

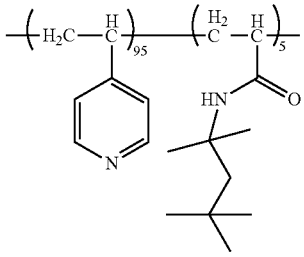

Polymer 7a: 4-VPy(N->Oxide)/OAA (95/5) Co-Polymer

In a flask equipped with a stir bar, condenser and thermocouple place 5.26 g Polymer 7, 50 g acetic acid, peracetic acid (made by mixing 25 g acetic acid and 6.4 g 30% H2O2) and 4-5 drops of sulfuric acid. Stir for 30 minutes at room temperature to dissolve Polymer 7. Next, heat the reaction mixture to 85 C and hold for 3 hours. After the 3 hours, cool to room temperature and allow to stir overnight at room temperature. Pour reaction mixture into 1 L acetone to precipitate the product. Agitate for 30 minutes. After this time, stop the agitation and allow product to settle and decant off the acetone. Add a second 1 L of acetone and agitate the mixture to 'wash' the precipitated product. Filter, wash with additional acetone and dry the product. The product will be a white/cream colored powder.

Representative Structure

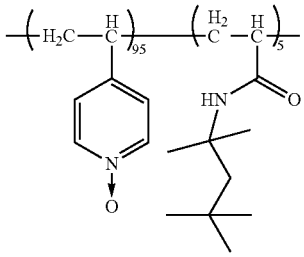

4-Vpy(N->O)/OAA

Polymer 8: 2-VPy/LMA (95/5) Co-Polymer

In a flask equipped with a stir bar, condenser, thermocouple and nitrogen purge place 239.0 g ethanol. Purge the solvent with nitrogen over 20 minutes. Heat the solvent to reflux. The following monomer feeds are prepared: monomer Feed 1 is 9.44 g lauryl methacrylate/10.00 g ethanol; monomer Feed 2 is 72.04 g 2-vinyl pyridine. Feed 1 is added to the reaction, drop-wise over 180 minutes (concurrently with Feed 2). Feed 2 is added to the reaction, drop-wise over 180 minutes (concurrently with Feed 1). In a separate vessel, a mixture of 1.0 g of Trigonox 25C 75 and 5.0 g of ethanol is prepared and is labeled as "Initiator Solution". After Feeds 1 and 2 have been adding for 10 minutes, add 1.0 g of the Initiator Solution to the reaction vessel. Continue the drop-wise addition of Feeds 1 and 2 to the reaction vessel. After 30 minutes of monomer feed, charge 1.0 g of the initiator solution to the reaction vessel. After 60 minutes of monomer feed, charge 1.0 g of the initiator solution to the reaction vessel. After 120 minutes of monomer feed, charge 1.0 g of the initiator solution to the reaction vessel. At the completion of the monomer feeds, charge the remaining initiator solution to the reaction vessel. Heat the reaction at reflux for an additional 3 hours. After the 3 hour heating charge the reaction vessel with 0.5 g of Triganox 25C 75 and hold for 120 minutes. Add an additional charge of 0.5 g Triganox 25C 75 and hold for 5 hours. Cool and collect reaction product.

Representative Structure of 2-VPy/LMA

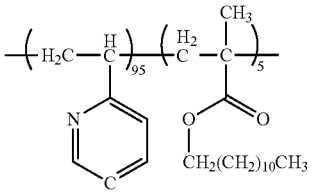

Polymer 8a: 2-VPy(N->Oxide)/LMA (95/5) Co-Polymer

In a flask equipped with a stir bar, condenser and thermocouple place 5.26 g Polymer 5, 50 g acetic acid, peracetic acid (made by mixing 25 g acetic acid and 6.4 g 30% H2O2) and 4-5 drops of sulfuric acid. Stir for 30 minutes at room temperature to dissolve Polymer 5. Next, heat the reaction mixture to 85 C and hold for 3 hours. After the 3 hours, cool to room temperature and allow to stir overnight at room temperature. Pour reaction mixture into 1 L isopropyl acetate to precipitate the product. Agitate for 30 minutes. After this time, stop the agitation and allow product to settle and decant off the isopropyl acetate. Add a second 1 L of isopropyl acetate and agitate the mixture to 'wash' the precipitated product. Filter, wash with additional isopropyl acetate and dry the product. The product will be a white/cream colored powder.

Representative Structure

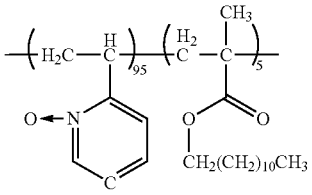

2-Vpy(N->O)/LMA

Polymer 9: 2-VPy/2-EHMA (95/5) Co-Polymer

In a flask equipped with a stir bar, condenser, thermocouple and nitrogen purge place 239.0 g ethanol. Purge the solvent with nitrogen over 20 minutes. Heat the solvent to reflux. The following monomer feeds are prepared: monomer Feed 1 is 7.36 g 2-ethylhexyl methacrylate/10.00 g ethanol; monomer Feed 2 is 72.04 g 2-vinyl pyridine. Feed 1 is added to the reaction, drop-wise over 180 minutes (concurrently with Feed 2). Feed 2 is added to the reaction, drop-wise over 180 minutes (concurrently with Feed 1). In a separate vessel, a mixture of 1.0 g of Trigonox 25C 75 and 5.0 g of ethanol is prepared and is labeled as "Initiator Solution". After Feeds 1 and 2 have been adding for 10 minutes, add 1.0 g of the Initiator Solution to the reaction vessel. Continue the drop-wise addition of Feeds 1 and 2 to the reaction vessel. After 30 minutes of monomer feed, charge 1.0 g of the initiator solution to the reaction vessel. After 60 minutes of monomer feed, charge 1.0 g of the initiator solution to the reaction vessel. After 120 minutes of monomer feed, charge 1.0 g of the initiator solution to the reaction vessel. At the completion of the monomer feeds, charge the remaining initiator solution to the reaction vessel. Heat the reaction at reflux for an additional 3 hours. After the 3 hour heating charge the reaction vessel with 0.5 g of Triganox 25C 75 and hold for 120 minutes. Add an additional charge of 0.5 g Triganox 25C 75 and hold for 5 hours. Cool and collect reaction product.

Representative Structure of 2-VPy/2-EHMA

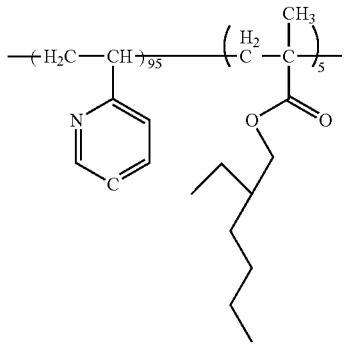

Polymer 9a: 2-VPy(N->Oxide)/EHMA (95/5) Co-Polymer

In a flask equipped with a stir bar, condenser and thermocouple place 5.26 g Polymer 6, 50 g acetic acid, peracetic acid (made by mixing 25 g acetic acid and 6.4 g 30% H2O2) and 4-5 drops of sulfuric acid. Stir for 30 minutes at room temperature to dissolve Polymer 6. Next, heat the reaction mixture to 85 C and hold for 3 hours. After the 3 hours, cool to room temperature and allow to stir overnight at room temperature. Pour reaction mixture into 1 L isopropyl acetate to precipitate the product. Agitate for 30 minutes. After this time, stop the agitation and allow product to settle and decant off the isopropyl acetate. Add a second 1 L of isopropyl acetate and agitate the mixture to 'wash' the precipitated product. Filter, wash with additional isopropyl acetate and dry the product. The product will be a white/cream colored powder.

Representative Structure

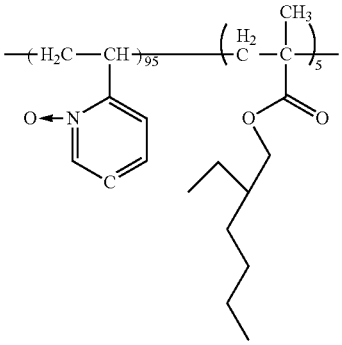

2-Vpy(N->O)/2-EHMA

Polymer 10: 4-VPy/OAA (95/5) Co-Polymer

In a flask equipped with a stir bar, condenser, thermocouple and nitrogen purge place 189.0 g ethanol. Purge the solvent with nitrogen over 20 minutes. Heat the solvent to reflux. The following monomer feeds are prepared: monomer Feed 1 is 6.79 g octylacrylamide/50.00 g ethanol (dissolve OAA in EtOH); monomer Feed 2 is 72.04 g 2-vinyl pyridine. Feed 1 is added to the reaction, drop-wise over 180 minutes (concurrently with Feed 2). Feed 2 is added to the reaction, drop-wise over 180 minutes (concurrently with Feed 1). In a separate vessel, a mixture of 1.0 g of Trigonox 25C 75 and 5.0 g of ethanol is prepared and is labeled as "Initiator Solution". After Feeds 1 and 2 have been adding for 10 minutes, add 1.0 g of the Initiator Solution to the reaction vessel. Continue the drop-wise addition of Feeds 1 and 2 to the reaction vessel. After 30 minutes of monomer feed, charge 1.0 g of the initiator solution to the reaction vessel. After 60 minutes of monomer feed, charge 1.0 g of the initiator solution to the reaction vessel. After 120 minutes of monomer feed, charge 1.0 g of the initiator solution to the reaction vessel. At the completion of the monomer feeds, charge the remaining initiator solution to the reaction vessel. Heat the reaction at reflux for an additional 3 hours. After the 3 hour heating charge the reaction vessel with 0.5 g of Triganox 25C 75 and hold for 120 minutes. Add an additional charge of 0.5 g Triganox 25C 75 and hold for 5 hours. Cool and collect reaction product.

Representative Structure of 4-VPy/OAA

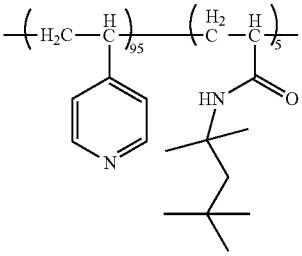

Polymer 10a: 2-VPy(N->Oxide)/OAA (95/5) Co-Polymer

In a flask equipped with a stir bar, condenser and thermocouple place 5.26 g Polymer 10, 50 g acetic acid, peracetic acid (made by mixing 25 g acetic acid and 6.4 g 30% H2O2) and 4-5 drops of sulfuric acid. Stir for 30 minutes at room temperature to dissolve Polymer 10. Next, heat the reaction mixture to 85 C and hold for 3 hours. After the 3 hours, cool to room temperature and allow to stir overnight at room temperature. Pour reaction mixture into 1 L isopropyl acetate to precipitate the product. Agitate for 30 minutes. After this time, stop the agitation and allow product to settle and decant off the isopropyl acetate. Add a second 1 L of isopropyl acetate and agitate the mixture to 'wash' the precipitated product. Filter, wash with additional isopropyl acetate and dry the product. The product will be a white/cream colored powder.

Representative Structure

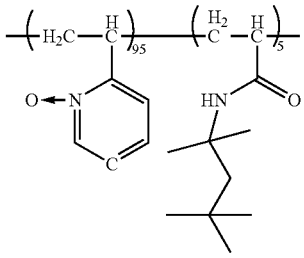

2-Vpy(N->O)/OAA

Polymer 11: Synthesis of VCap/VEOVA-10 (95/5)

Feed one is prepared with 48.99 g vinyl caprolactam (VCap) and 24.50 g ethanol. Put 100 g ethanol in the reactor and add 3.67 g vinyl neodecanoate (VEOVA-10) as a shot to the reactor. Commence purging of the reaction vessel with nitrogen. Heat the reaction flask containing VEOVA and ethanol to reflux—approximately~78 C. In a separate vessel prepare a mixture of Triganox 25C 75 (0.5) and ethanol (2.5 g). Label this vessel "Triganox Solution". When the reaction flask has reached reflux temperature, begin adding Feed 1, drop-wise, in to the reaction vessel over a period of 120 minutes. After 10 minutes of monomer feed, add 0.5 g of the Triganox Solution into the reactor via syringe. Continue the drop-wise addition of Feed 1 over a period of approximately 120 minutes. While the monomers are feeding into the reactor, after 30 minutes charge 0.5 g of the Triganox solution. After 60 minutes, charge 0.5 g Triganox solution into the reactor. After 90 minutes, charge 0.5 g Triganox solution into the reactor. At the completion of the monomer feeds, charge the reaction vessel with the remainder of the Triganox solution. The reaction vessel is allowed to heat at reflux for an additional 180 minutes. Note: during the initiator shots, additional ethanol was added to replace any that has volatilized. Cool the reaction vessel and leave the material in the reactor. This is the end of 'day one'. On 'day two', re-heat the vessel to reflux and charge with 1.0 g Triganox 25C 75. Hold for 2 hours. Add an additional 1.0 g Triganox 25C 75. Hold for 5 hours then cool reaction mixture.

Representative Structure

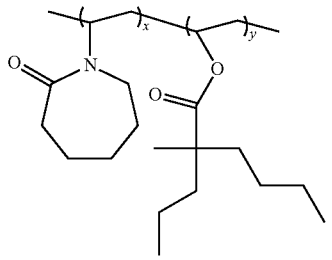

In one embodiment of the present invention at least one monomer selected is hydrolyzable. Examples of hydrolyzable monomers include vinyl acetate, vinyl alcohol, methylene dioxepane, and acrylated lactams. The copolymers/terpolymers become slowly biodegradable by common soil microorganisms when ester linkage containing polymer units is as low as 2%, however they become much more rapidly biodegraded when ester linkage percentage increases greater than 10%.

The hydrophobically modified polymer can be used in an amount from 0.001 to 50 weight percent, based on the total weight of the cleansing composition, more particularly in an amount of from 0.01 to 25 weight percent and still more particularly in an amount from 0.1 to 5 weight percent.

The cleansing composition according to the invention can be prepared by any conventional manufacturing technique used for preparing detergent compositions, such as a slurry of the common physical forms associated with detergents, such as powders, flakes, granules, noodles, cakes, bars and liquids.

The cleansing composition may be in the form of liquid, solid, semisolid, emulsion, dispersion, or a gel. In yet another embodiment, the cleaning composition containing a functional additive may be incorporated onto a non-woven textile.

The cleansing composition of the present invention can include other usual detergent components selected from the group consisting of surfactants, builders, chelants, bleaching agents, oxidizing agents, supplementary soil-suspending agents, foam suppressors, additional soil release agents, optical brighteners, abrasives, bactericides, tarnish inhibitors, coloring agents, perfumes, or mixtures thereof.

The present invention also provides method of cleaning fabric with enhanced anti soil-redeposition and/or minimizing dye transfer during the wash cycle of a laundering process comprising (a) washing a load of fabrics in a wash solution containing a cleansing composition comprising functional additives having enhanced anti soil-redeposition and/or dye transfer inhibitory activities comprising polymers in the form of homopolymers, copolymers or terpolymers synthesized from at least one hydrophobic monomer; (b) rinsing the load of fabrics; (c) drying the load of fabrics; and (d) washing all or part of said load of fabrics, together with or without additional fabrics, the load releasing an effective amount of anti soil-redeposition effect and/or dye transfer inhibitor into a wash solution containing a cleansing composition. Examples of hydrophobic monomers include N-vinyl caprolactam, vinyl acetate, vinyl esters, acrylated glycols, methacrylamide, C1 to C12 alkyl- and C1 to C12 dialkylacrylamide, C1 to C12 alkyl- and C1 to C12 dialkylmethacrylamide, C1 to C12 alkyl acrylate, C1 to C12 alkyl methacrylate, 4-butyl phenyl maleimide, octyl acrylamide.

The fabric can be selected from the group consisting of cotton, denim, polyacrylics, polyamides, polyesters, polyolefins, rayons, wool, linen, jute, ramie, hemp, sisal, regenerated cellulosic fibers such as rayon or cellulose acetate, leather, and combinations thereof.

The functional additive of the present invention can be used as a premix or is reconstituted into a liquid composition prior to addition to the wash solution or forms the integral part of cleansing composition.

Test results demonstrating ASR functionality, in the absence of detergent are presented in below.

ASR Test Method for Screening FPA

Apparatus & Materials:

Terg-O-Tometer (Lab Scale Washing Machine)

Hunter Color Quest II Sphere (Colorimeter)

Purex Ultra Conc. Natural Elements Linen & Lilies Liquid Detergent

Cotton 400

Polyester 777

Cotton PEDP 7435WRL

Nylon 361

Dust Sebum Emulsion

Clay Slurry

Fabrics, Dust sebum and Clay slurry are obtained from Scientific Services S/D, P.O. Box 778-42 Main Street, Sparrow Bush, N.Y. 12780

Web Site: http://www.sciservsd.com/

Preparation of Solution:

1. Stock solution of hard water is made by adding 3.3 g/L of calcium chloride dehydrate and 1.5 g/L of magnesium chloride hexahydrate to $DiH_2O$.
2. A 1 wt. % polymer solution is made based on the active material to use for the test.

Procedure:

A solution containing 3.1 g of dust sebum, 1.9 g of clay slurry, polymer (320 ppm), and 25 g (150 ppm) hard water stock sol'n are diluted to 0.5 L with $DiH_2O$. Mix solution well and place it into Terg-O-Tometer. Once the solution has equilibrated to 100° F., one new polyester, cotton/polyester, nylon, & cotton fabrics are added to each bin and the washing process is conducted for 30 minutes at an agitation rate of 100 cycles/minute. Subsequently swatches are removed from the bin and excess water is squeezed by hand. Rinse is prepared containing 25 g (150 ppm) hard water, which is again diluted to 0.5 L with $DiH_2O$ and placed into a Terg-O-Tometer. Fabrics are rinsed for 3 minutes and excess water is squeezed by hand and the swatches are allowed to air dry.

A minimum of six reflectance measurements (3 on front and 3 on back of the fabric) are taken per swatch using a Hunter Colorimeter Color Quest II Sphere. Record the values of reflectance between 450-470 nm and between Δ450-470 nm. To compare products use value for ΔR at 460 nm value, the difference between the starting fabric and the washed fabric. The values of ΔR at 460 nm should be a negative value. The value for ΔR at 460 nm closer to zero, better the performance of the material.

Examples of ASR test results are presented in Table 1 and FIG. 1:

TABLE 1

ASR on Experimental Materials without Detergent
Temp: 100 F.
Polymer: 320 ppm

| Polymers | ΔR at 460 nm | | | |
|---|---|---|---|---|
| | Cotton | Polyester | Cotton/ Polyester | Nylon |
| Control | −11.73 | −54.42 | −29.26 | −47.50 |
| PVCap/VA (11885-30) | −2.00 | −24.98 | −7.97 | −21.23 |
| VCap/VA Hydrolized (11892-131) | −2.22 | −24.04 | −7.15 | −25.26 |
| VCap/VI/VA (11885-45) | −5.66 | −18.34 | −5.88 | −16.36 |
| VCap/VINO/VA (11892-148) | −7.42 | −21.18 | −7.21 | −15.63 |
| VCap/VPyNO/VA (11892-140) | −4.24 | −30.65 | −6.59 | −18.39 |
| VCap/VA/OAA (11931-110) | −5.40 | −22.70 | −7.74 | −20.13 |
| VCap/VI/VA/OAA (11931-112) | −6.03 | −18.40 | −5.60 | −14.34 |
| VP/OAA (11894-11) | −2.16 | −28.92 | −5.69 | −18.09 |
| VCap/BAEMA/HEMA (11885-43) | −4.37 | −31.23 | −11.23 | −34.48 |
| VP/EHMA (11955-6) | −3.88 | −27.99 | −4.34 | −16.85 |
| VP/LMA (11955-5) | −2.86 | −20.43 | −2.92 | −1.53 |

ASR Test Method for a Commercial Detergent

Apparatus & Materials:
Terg-O-Tometer (Lab Scale Washing Machine)
Hunter Color Quest II Sphere (Colorimeter)
Purex Ultra Conc. Natural Elements Linen & Lilies Liquid Detergent
Cotton 400
Polyester 777
Cotton PEDP 7435WRL
Nylon 361
Dust Sebum Emulsion
Clay Slurry
Fabrics, Dust sebum and Clay slurry are obtained from Scientific Services S/D, P.O. Box 778-42 Main Street, Sparrow Bush, N.Y. 12780
Preparation of Solution:
1. 4% polymer is added to the Henkel/Dial's Purex Ultra Concentrate Natural Elements Linen & Lilies
2. Stock solution of hard water is made by adding 3.3 g/L of calcium chloride dehydrate and 1.5 g/L of magnesium chloride hexahydrate to $DiH_2O$.

Procedure:

A solution containing 3.1 g of dust sebum, 1.9 g of clay slurry, 0.5 g (1000 ppm) Purex Ultra Conc. NE L&L detergent containing 4% inventive polymer, and 25 g (150 ppm) hard water stock sol'n are diluted to 0.5 L with $DiH_2O$. Mix solution well and place it into Terg-O-Tometer. Once the solution has equilibrated to 100° F., one new polyester, cotton/polyester, nylon, & cotton fabrics are added to each bin and the washing process is conducted for 30 minutes at an agitation rate of 100 cycles/minute. Subsequently swatches are removed from the bin and excess water is squeezed by hand. Rinse is prepared containing 25 g (150 ppm) hard water, which is again diluted to 0.5 L with $DiH_2O$ and placed into a Terg-O-Tometer. Fabrics are rinsed for 3 minutes and excess water is squeezed by hand and the swatches are allowed to air dry.

A minimum of six reflectance measurements (3 on front and 3 on back of the fabric) are taken per swatch using a Hunter Colorimeter Color Quest II Sphere. Record the values of reflectance between 450-470 nm and between Δ450-470 nm. To compare products use value for ΔR at 460 nm value, the difference between the starting fabric and the washed fabric. The values of Δλ at 460 nm should be a negative value. The value for ΔR at 460 nm closer to zero, better the performance of the material.

Figure 2:
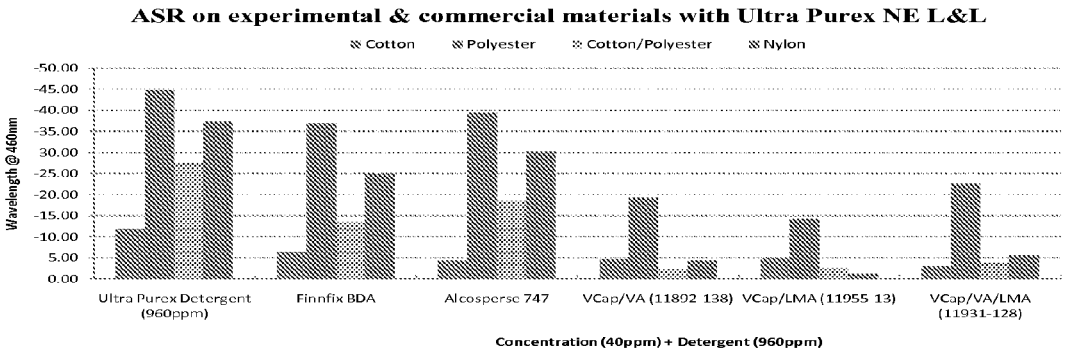
FIG. 2 is a graph illustrating the ASR on for inventive and comparative examples with detergent.

Examples of ASR test results in a commercially available detergent are presented in Table 2 and FIG. 2:

TABLE 2

Purex Ultra Detergent Concentrate ASR
Test Results

| | Cotton | Polyester | Cott/Poly | Nylon |
|---|---|---|---|---|
| Control | −11.91 | −44.68 | −27.46 | −37.27 |
| Finnfix BDA | −7.34 | −38.95 | −15.88 | −27.08 |
| Alcosperse 747 | −10.07 | −45.47 | −23.43 | −37.77 |
| VCL/VA (11931-138) P2 | −1.75 | −12.31 | −1.72 | −2.95 |
| VCL/VI/VA (11931-45) | −10.74 | −39.92 | −17.96 | −31.53 |
| VCL/LMA (11955-13) | −2.39 | −13.97 | −2.82 | −0.4 |
| VCL/VA/LMA (11931-128) | −3.00 | −22.54 | −3.78 | −5.52 |

Test Procedure to Measure DTI Performance

The procedure followed is a slight modification of the ASTM D-5548-95. In ASTM D-5548-95, a dyed cloth is used and the re-deposition of the bled dye from the dyed cloth onto a white cloth is tested. In ISP testing method, an added amount of a known concentration of the dye is measured and its deposition onto a white fabric is determined 1. A solution containing 10 ppm dye (Aldrich), polymer (10 ppm), 1 g/L Wisk regular liquid detergent and 110 ppm hard water (Ca:Mg::3:1) is diluted to 1 L with $DiH_2O$ and placed into Terg-O-Tometer.
2. Once the solution has equilibrated to 100° F., two cotton swaths are added and the washing process is conducted for 10 minutes at an agitation rate of 100 cycles/minute.
3. The swatches are subsequently removed and rinse is prepared containing 110 ppm hard water (Ca:Mg::3:1), which is again diluted to 1.0 L with $DiH_2O$ and placed into a Terg-O-Tometer. Fabrics are rinsed for 3 minutes and excess water is squeezed by hand, swatches are allowed to dry.
4. Once dried, a total of six reflectance measurements (3 measurement on each fabric) are taken using a Hunter Colorimeter (Color Quest II) to obtain the average L,a,b, and ΔE values. The ΔE value is reported, it is the difference between the starting fabric and the washed fabric. ΔE value closer to zero indicates less deposition of the dye on to the fabric.

Examples of DTI test results in a commercially available detergent are presented in Table 3:

TABLE 3

Wisk Detergent Concentrate FPA - DTI Test Results

| Polymer | dE-Value |
|---|---|
| Control - no polymer | 34.5 |
| PVP K-30 | 26.1 |
| VCL/VI/VA | 16.1 |
| VP-co-4-butyl phenyl maleimide | 3.3 |

We claim:

1. A cleaning composition comprising as an integral part of said composition functional additive having enhanced anti soil-redeposition and/or dye transfer inhibitory activities comprising an uncross-linked polymer selected from the group consisting of

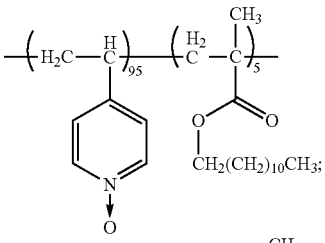

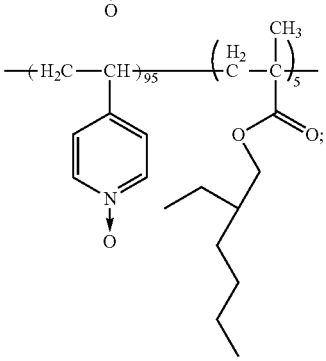

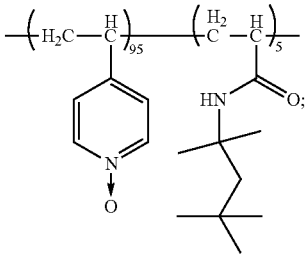

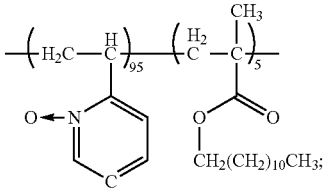

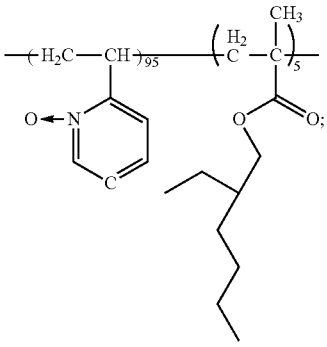

-continued

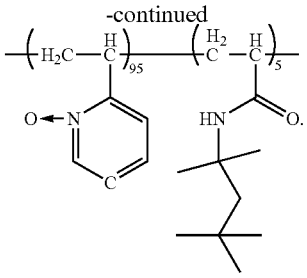

2. The cleansing composition according to claim 1 wherein said cleansing composition is in the form of a liquid, solid, semisolid, emulsion, dispersion or gel.

3. The cleansing composition according to claim 1 wherein said functional additive is present in an amount of from 0.001 to 50 weight percent, based on the total weight of the cleansing composition.

4. A cleansing composition according to claim 3, wherein the functional additive is present in an amount of from 0.01 to 25 weight percent.

5. A cleansing composition according to claim 4, wherein the functional additive is present in an amount of from 0.1 to 5 weight percent.

6. The cleansing composition according to claim 1 further comprising at least one of a surfactant, builder, chelant, bleaching agent, oxidizing agent, supplementary soil-suspending agent, foam suppressor, additional soil release agent, optical brightener, abrasive, bactericide, tarnish inhibitor, coloring agent, and perfume.

7. A method of cleaning fabric with enhanced anti soil-redeposition and/or minimizing dye transfer during the wash cycle of a laundering process comprising the following steps:

(a) washing a load of fabrics in a wash solution containing a cleansing composition according to claim 1;

(b) rinsing said load of fabrics;

(c) drying said load of fabrics; and (d) washing all or part of said load of fabrics, said load releasing an effective amount of anti soil-redeposition effect and/or dye transfer inhibitor into a wash solution containing a cleansing composition.

8. The method according to claim 7, wherein said wash solution contains at least some colored fabrics which release dyes and contains fabrics which will be discolored by the released dyes.

9. The method according to claim 8, wherein said fabric is selected from the group consisting of cotton, denim, polyacrylics, polyamides, polyesters, polyolefins, rayons, wool, linen, jute, ramie, hemp, sisal, regenerated cellulosic fibers leather, and combinations thereof.

* * * * *